US005499402A

United States Patent [19]

Rose

[11] Patent Number: 5,499,402

[45] Date of Patent: Mar. 19, 1996

[54] ATTACHMENT TO ADJUSTABLE STRAP ON BASEBALL CAPS

[76] Inventor: Michael J. Rose, 3247 Morino Ave., San Jose, Calif. 95127

[21] Appl. No.: 131,765

[22] Filed: Oct. 4, 1993

[51] Int. Cl.[6] ..... A42B 1/24

[52] U.S. Cl. ..... 2/209.13; 2/181.4; 40/329

[58] Field of Search ..... 2/209.13, 181, 2/181.2, 181.4, 195.1, 195.2, 195.3, 195.4; 24/555, 563, 580; 40/329

[56] References Cited

U.S. PATENT DOCUMENTS

| | | | |
|---|---|---|---|
| 4,776,043 | 10/1988 | Coleman | 2/199 |
| 4,872,218 | 10/1989 | Holt | 2/171.5 |
| 4,946,065 | 8/1990 | Goulter et al. | 24/563 |
| 5,003,640 | 4/1991 | Pizzacar | 2/199 |
| 5,170,509 | 12/1992 | Leopold | 2/199 |
| 5,315,714 | 5/1994 | Peters et al. | 2/209.13 |

FOREIGN PATENT DOCUMENTS

| | | | |
|---|---|---|---|
| 22195 | of 1915 | United Kingdom | 24/563 |

*Primary Examiner*—Diana Biefeld
*Attorney, Agent, or Firm*—Julian Caplan; Flehr, Hohbach, Test, Albritton & Herbert

[57] ABSTRACT

Caps of the type used by baseball players but also used by other athletes and their fans have an opening at the back. A strap is attached to the headband of the cap on either side of the opening and the straps can be used to adjust the cap to fit the head size of the wearer by overlapping the ends of the straps to the necessary extent. One strap usually has spaced holes and the other spaced studs which fit into the holes. The present invention provides a panel which may carry the logo of a team, a merchandiser's advertisement or other design. The panel is secured to the overlapped straps in various ways described in detail.

2 Claims, 5 Drawing Sheets

ATTACHMENT TO ADJUSTABLE STRAP ON BASEBALL CAPS

BACKGROUND OF THE INVENTION

1. Field of the Invention

This invention relates to a new and improved attachment on adjustable straps on baseball-type caps. More particularly, the invention relates to an attachment which carries a logo or advertising message herein referred to as "logo" which is attached to the adjustable straps commonly used on baseball caps and caps of similar type to accommodate varying head sizes. Further, the attachment conceals the straps and at least part of the opening formed in the back of the cap.

2. Description of Related Art

Baseball-type caps are widely used and frequently bear logos on the front. Commonly these baseball caps are formed with an opening in the back and are made adjustable for various head sizes by means of straps attached to the headband which overlap at the opening. Frequently one strap has a series of spaced holes and the other has one or more studs which may be forced into the holes to secure the straps in proper adjustment.

Attachments to these straps have also been used. One type of attachment prevents the hair of the wearer from protruding through the opening in the back of the cap. Still another attachment is a hair band for protruding hair. Removable name plates with logos have also been attached to the straps by loops similar to belt loops and in other ways.

The present invention discloses and claims various ways of attaching logos to the adjustment straps in novel ways.

SUMMARY OF THE INVENTION

Caps which are commonly referred to as "baseball caps" are many times made with an opening at the back of the cap. Two adjustment straps are horizontally disposed, one on top of the other extending across the bottom edge of the opening. The outer edge of each strap is fixed to the headband of the cap. The overlapped straps are adjustable in relation to each other to adjust for the head size of the wearer.

In accordance with one form of the invention a sleeve slips over the two straps, a portion of the sleeve which is exposed at the rear of the cap carries the logo. Alternatively the logo may be applied in various ways to a patch which is attached to the sleeve by interfitting snaps on the patch and sleeve.

Instead of a complete sleeve, a fabric portion may fit behind the overlapped adjustment straps and be affixed at its ends to the back of a patch which is located to the rear of the adjustment straps. In still another version of the invention, the patch carrying the logo may be affixed to a fabric or flexible plastic or metal member. The upper end of the member folds over the top of the adjustment straps and behind them while the fabric at the bottom of the patch folds under the lower edges of the straps and extends behind the first-mentioned member. The overlapped fabric edges may be fastened by Velcro® fastening means or other methods.

Alternatively the patch may be attached to a sleeve which fits over the adjustment straps by a Velcro® fastening means.

In a further alternative, the patch has spring clips fixed thereto which fit over the overlapped adjusting straps.

Other means include a portion of the patch which is bent or formed to fit over the straps.

A plastic member which is U-shaped in cross section may be used to display the logo on one surface. The device is slipped over the adjustment straps and there are angular lips at the bottom edge which engage under the bottom edges of the straps to hold the device in place.

As still another alternative, the patch may be secured to the rearmost adjustment strap by an adhesive.

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
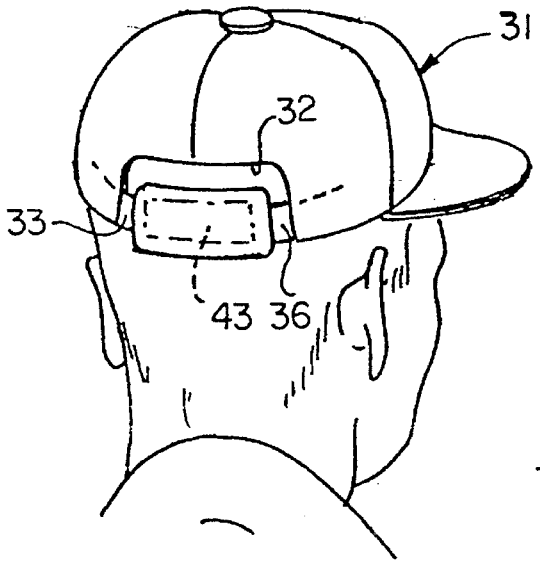
FIG. 1 is a perspective view showing a baseball cap on the head of a wearer with the .device of the present invention applied to the adjustment straps of the cap.
Figure 2:
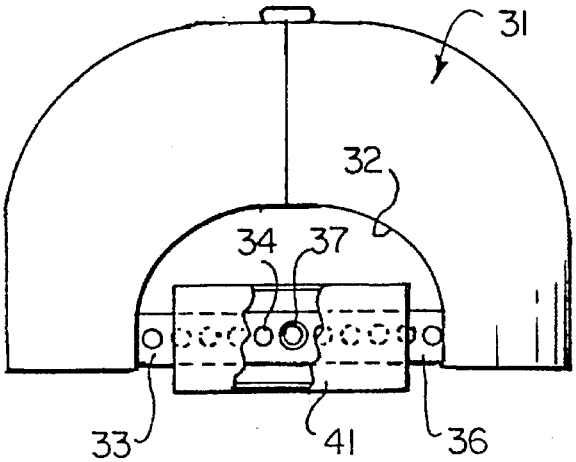
FIG. 2 is a rear elevational view partly broken away in section to show interior construction.
Figure 5:
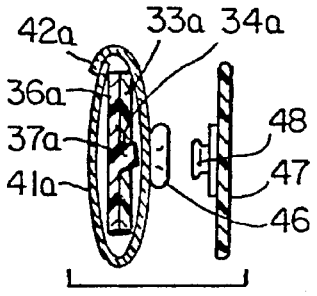
FIG. 5 is an exploded cross-sectional view taken substantially along the line 5—5 of FIG. 4.

Directing attention to FIGS. 1 and 2, a common type of baseball cap 31 is illustrated. The back of cap 31 is formed with an opening 32. Sizing strap 33 is connected to the headband (not shown) of the cap and extends horizontally part way across the opening 32 aligned with the bottom edge of the cap. Strap 33 is formed with holes 34 at spaced intervals. A second sizing strap 36 is connected at its right end to the headband of the cap and extends across the opening 32 overlapping strap 33. Strap 36 has a plurality of studs 37 which are slightly larger than the holes 34. The straps 33 and 36 are adjusted according to the head size of the wearer and thereupon studs 37 are pushed through appropriate holes 34 to hold the straps in proper adjustment. It will be understood that other means for holding the straps in a position of adjustment may be used, but the illustrated cap is one very commonly commercially available.

Figure 3:
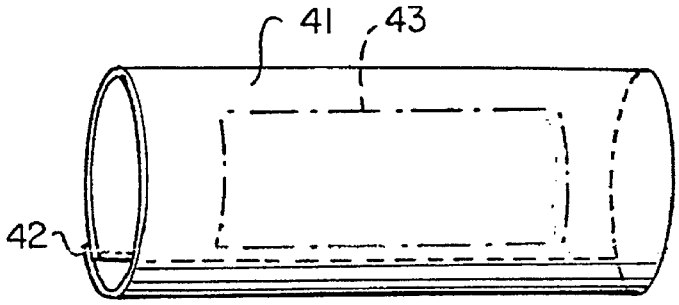
FIG. 3 is an enlarged view of a sleeve used in the modification of FIG. 2 prior to its being installed on the cap.

The present invention provides a means which at least partially covers the straps and partially blocks the opening 32 and which preferably carries printing and art work advertising and athletic team and/or a product herein referred to as "logos". In the modification shown in FIGS. 1–3, inclusive, sleeve 41 is formed of fabric foil or plastic material, the longitudinal edges of the sleeve 41 being joined in a seam 42 secured by adhesive, stitching or other means. It will further be understood that the sleeve may be seamless. A logo 43 is applied to the sleeve 41 by printing, stitching, silk screening or other means.

In use, sleeve 41 is slipped over one of the straps 33 or 36 prior to adjustment, then the other strap is slipped into the sleeve and the studs 37 inserted in the appropriate holes 34. The sleeve 41 is turned so that the logo 43 is displayed and flattened. Thus the sleeve 43 covers at least a considerable portion of the straps 33 and 36 and partially covers the opening 32.

Figure 4:
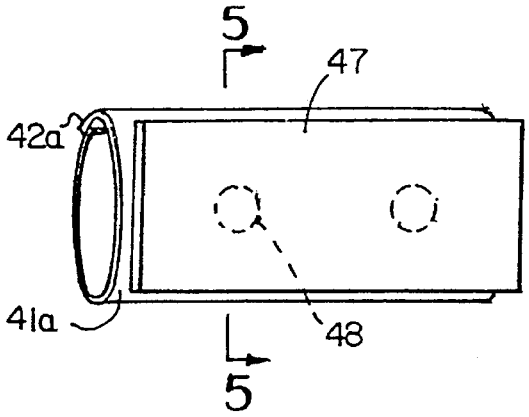
FIG. 4 is a perspective view of a modification.

FIG. 4 illustrates a modification wherein sleeve 41*a* is provided with one or more snaps 46. A patch 47 or plaque which carries the appropriate logo (not shown) on its outer face is provided on its inner face with snap 48 which mates with snap 46. This enables the user to interchange patches 47 whenever desired.

Figure 7:
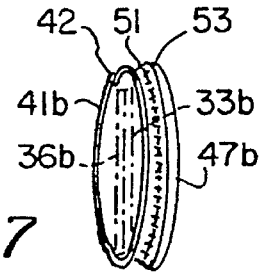
FIG. 7 is an end view of the structure of FIG. 6.
Figure 6:
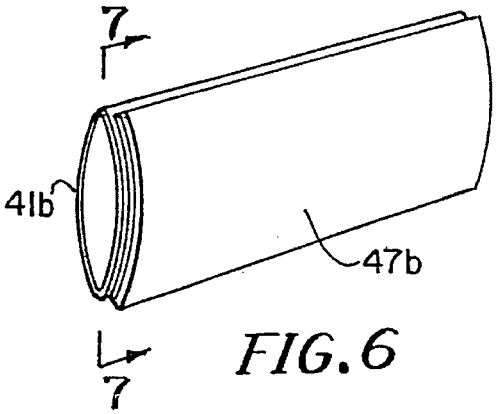
FIG. 6 is a view similar to FIG. 4 of another modification of the invention.

Directly attention to FIGS. 6 and 7, a Velcro®-type fastening is used to secure the patch 47*b* to the sleeve 41*b*. Thus the hook-like element portion 51 of the fastener is secured to the sleeve 41*b* by adhesive or other means and the felt-like portion 53 of the fastener is similarly secured to the back of the patch 47*b*. When the patch 47*b* is pushed against sleeve 41*b*, the fastening elements 51 and 53 inter-engage but can be separated by pulling them apart if the user desires to change the patch 47*b*.

Figure 9:
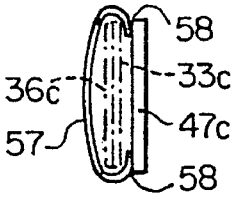
FIG. 9 is an end view of the structure of FIG. 8.
Figure 8:
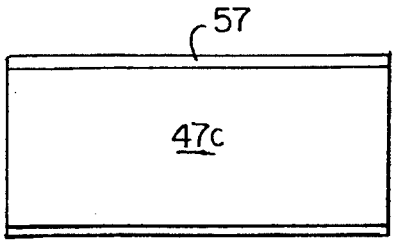
FIG. 8 is an elevational view of a further modification.

FIGS. 8 and 9 show a modification of the structure of FIG. 2. A "partial" sleeve 57 in the assembled position of the device on a cap is behind the rearmost strap 36*c*. Partial sleeve 57 is folded over the upper edges of straps 33*c*, 36*c* and is attached by attachment means 58 to the rear of patch 47*c*. Similarly sleeve 57 is folded under straps 33*c*, 36*e* and attached by attachment means 58 to the rear of patch 47*c*.

Figure 11:
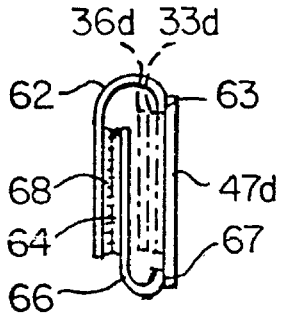
FIG. 11 is an end view showing how the portions of the modification of FIG. 10 may be folded and inter-engaged to fit onto adjustment straps.
Figure 10:
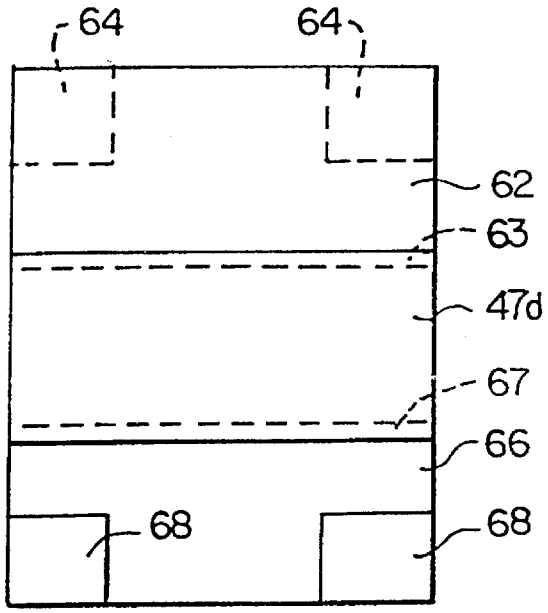
FIG. 10 is an elevational view of a still further modification.

FIGS. 10 and 11 employ a patch 47*d* similar to the patches heretofore described. Upper flap 62 of fabric foil plastic or light metal is attached by attachment means 63 to the upper edge of patch 47*d*. Small pieces of Velcro®-like material 64 may be attached to the upper corners of flap 62 or they may extend over a greater or lesser surface thereof than illustrated. Lower flap 66 is attached by attachment means 67 to the lower edge of patch 47*d* and one face thereof carries Velcro®-like attachments 68. As best shown in FIG. 11, when the patch 47*d* is positioned in front of adjustment strap 33*d*, the lower flap 66 is folded over behind strap 36d while the upper flap 62 is folded behind flap 66. The Velcro®-like attachment means 64 and 68 inter-engage, holding the patch 47*d* in place.

Figure 14:
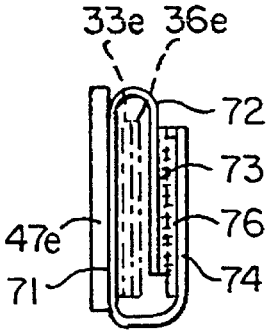
FIG. 14 is a view showing how the modification of FIG. 12 is folded and inter-engaged to fit over cap adjustment straps.
Figure 12:
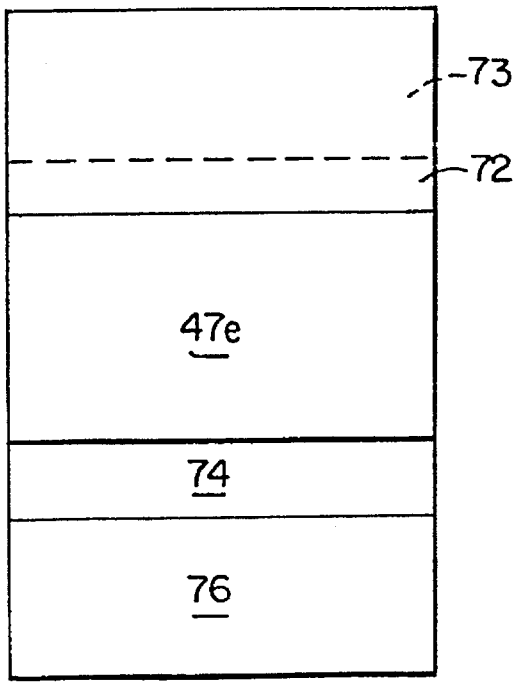
FIG. 12 is an elevational view of a still further modification.
Figure 13:
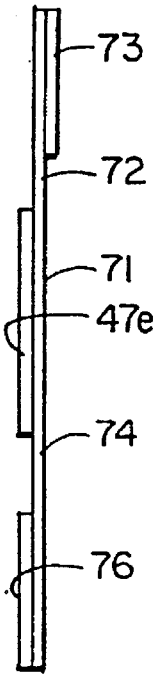
FIG. 13 is an end elevational view of the structure of FIG. 12.
Figure 16:
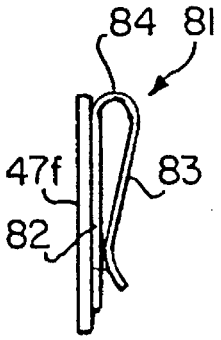
FIG. 16 is an end view showing how the modification of FIG. 15 is applied to adjustment straps.

FIGS. 12–14 resemble the structure of FIGS. 10–11. In this modification, however, a backing 71 is attached by adhesive or any other suitable means to the back of patch 47*e*. Upper flap 72 constitutes a continuation of the portion of backing 71 which is behind the patch 47*e* while lower flap 74 constitutes a downward continuation thereof. Velcro®-like material 73 and 76 (which may be of sufficient size so as to securely hold the device in place but is here shown as being bands across the top and bottom edges of flap 72 and 74 respectively) are inter-engaged as best shown in FIG. 14.

Figure 15:
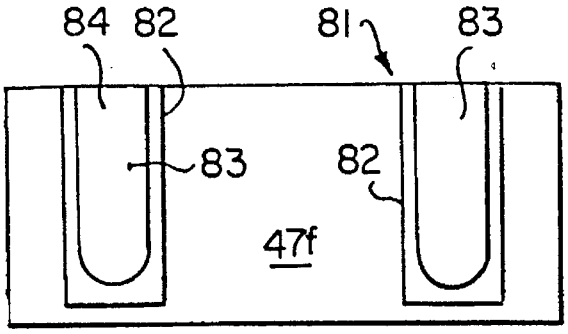
FIG. 15 is an elevational view of a still further modification.

In FIG. 15, patch 47 is provided with spring clips 81. The particular type of spring clip illustrated has a leg 82 which is secured to the back of patch 47*f* and a bent leg 83 connected to leg 82 by bend 84. Clips 81 are clipped over the straps 33, 36 to hold the patch 47*f* in position.

Figure 18:
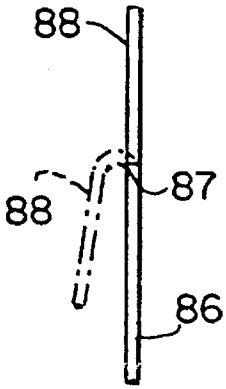
FIG. 18 is an end view showing in solid lines the structure of FIG. 17 and in dot-and-dash lines how the device may be bent to engage the adjustment straps.
Figure 17:
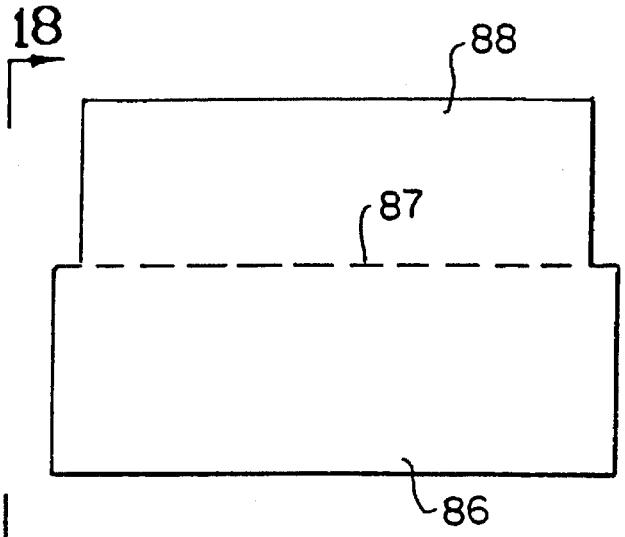
FIG. 17 is an elevational view of a further modification.

In the modification of FIGS. 17–18 patch 86 is made of metal or bendable plastic. It has an upper extension 88 attached to its upper edge by hinge 87. The extension 88 may be folded down as shown in dot-and-dash lines in FIG. 18 to engage the back of the adjustment straps of the cap.

Figure 19:
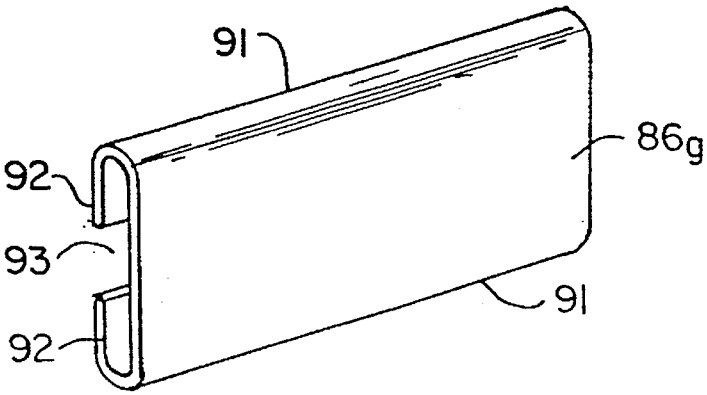
FIG. 19 is a perspective view of still another modification showing a patch with the edges turned over to engage the adjustment strap.

FIG. 19 illustrates a modification in which patch 86*g* is formed of a material which may be formed at rolled edges 91 so that there are back flanges 92 behind and parallel to the patch 86*g*. It will be noted that there is a gap 93 between the facing edges of flanges 92. The gap 93 facilitates installation of the patch 86*g* onto the straps 33, 36 (not shown).

Figure 20:
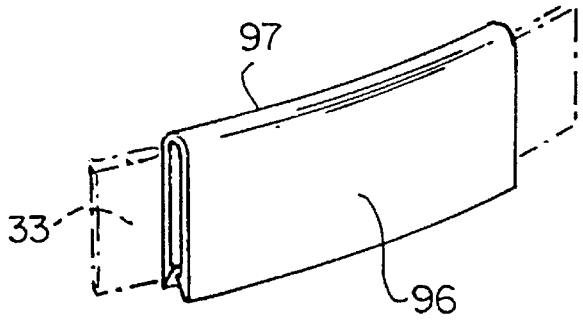
FIG. 20 is a schematic perspective view of a still further modification.
Figure 21:
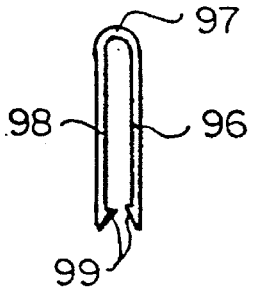
FIG. 21 is an end view of the structure of the modification of FIG. 20.

In FIGS. 20 and 21 a front member 96 is provided to which the logo or printed material may be applied. To the rear of and parallel to front 96 is a rear member 98 connected thereto by rolled fold 97 at the top. On the lower edges of members 96 and 98 are inward directed tangs 99. Preferably members 96, 98 are curved in arcs of about 2°–3° to conform to the shape of the back of the head. The device is installed by slipping it downward over the straps 33, 34, the material of construction being sufficiently flexible so as to permit the tangs 99 to be forced apart. After installation, the tangs 99 move together and prevent dislodgement of the device.

Figure 23:
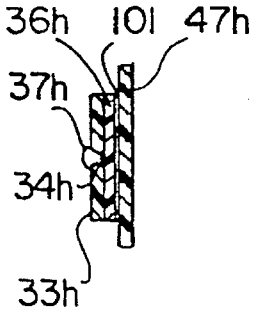
FIG. 23 is a sectional view taken substantially along the line 23 of FIG. 22.
Figure 22:
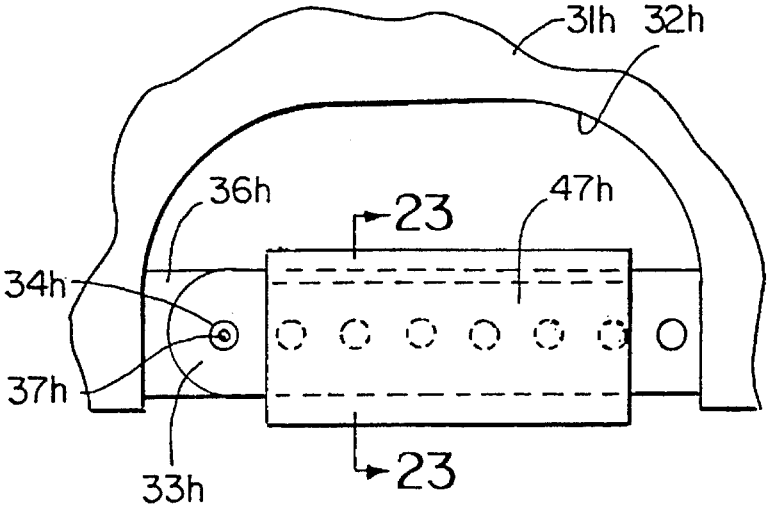
FIG. 22 is a fragmentary rear elevational view showing application of still another modification to the adjustment straps.

FIGS. 22, 23 show a further modification. In this modification patch 47*h* is attached by adhesive 101 to the front of strap 36*h*.

In many respects the modification of FIGS. 6, 8, 10, 12, 15, 19 and 23 resemble preceding modifications and the same reference numerals followed by the subscripts a, b, c, d, e, f, g, and h, respectively, are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the :scope of the invention be defined by the claims appended hereto and their equivalents.

What is claimed is:

1. In combination, a logo display and a cap to fit a human head, said cap having an opening at the rear and a pair of headband adjustment straps extending across said opening, said logo display comprising a generally tubular flexible member shaped and dimensioned to fit around said adjustment straps to at least partially enclose said adjustment straps and a front member having a logo thereon comprising a part of said flexible member wherein the logo faces rearwardly of said cap, said flexible member also having a fold along one edge thereof, said flexible member also comprising a rear member integral with said fold and spaced behind said front member, said front member being flat and rectangular and depending from said fold, said rear member being flat and rectangular depending from said fold and parallel to said front member, said flexible member further comprising first and second tangs on facing edges of said front member and rear member remote from said fold, said first and second tangs being generally triangular in cross section and having upper sides projecting inwardly horizontally perpendicular to said front member and said rear member, respectively, and having inward facing sides slanting downwardly-outwardly from said upper sides whereby said straps fit between said front member and said rear member and between said fold and said tangs.

2. A logo display according to claim 1 in which said front member and said rear member are curved to conform to the shape of the rear of a head.

* * * * *